United States Patent [19]

Mächerle et al.

[11] Patent Number: 4,535,916

[45] Date of Patent: Aug. 20, 1985

[54] GLUE GUN

[75] Inventors: Günter Mächerle, Kandel/Pfalz; Ludwig Lieber, Steinweiler, both of Fed. Rep. of Germany

[73] Assignee: Fritz Eichenauer, Pfalz, Fed. Rep. of Germany

[21] Appl. No.: 483,616

[22] Filed: Apr. 11, 1983

[30] Foreign Application Priority Data

Apr. 10, 1982 [DE] Fed. Rep. of Germany ..... 3213547

[51] Int. Cl.[3] ..... B67D 5/66

[52] U.S. Cl. ..... 222/113; 222/146.2; 126/414; 431/256

[58] Field of Search ..... 222/113, 129, 130, 131, 222/146 R, 146 H, 146 S, 391; 228/53; 126/229, 234, 236, 237, 239, 284, 414; 431/256

[56] References Cited

U.S. PATENT DOCUMENTS

| | | | |
|---|---|---|---|
| 2,997,869 | 8/1961 | Weiss | 67/7 |
| 3,020,907 | 2/1962 | Lease, Sr. | 126/229 |
| 3,204,828 | 9/1965 | Paulsen | 228/53 X |
| 3,261,390 | 7/1966 | Saito et al. | 228/53 X |
| 3,551,640 | 12/1970 | Duke, Jr. | 219/214 |
| 3,913,592 | 10/1975 | Morane et al. | 132/33 |
| 4,220,443 | 9/1980 | Bear | 431/91 |
| 4,301,946 | 11/1981 | Goldin et al. | 222/113 |
| 4,435,636 | 3/1984 | Royston | 228/53 X |

FOREIGN PATENT DOCUMENTS 419825 11/1934 United Kingdom .

*Primary Examiner*—Joseph J. Rolla
*Assistant Examiner*—Michael S. Huppert
*Attorney, Agent, or Firm*—Antonelli, Terry & Wands

[57] ABSTRACT

In a glue gun for conducting adhesive bonding by means of a heated adhesive, with a housing having a heating section and an angled handle, a hollow, thermally conductive block being arranged in the heating section for the accommodation of adhesive, the provision is made, to afford the possibility of using the glue gun independently of an external fuel supply, that a hollow combustion chamber provided with air inlet openings is fashioned integrally with the metal block; that a fuel tank is arranged in the handle; and that a connecting conduit is extended from the tank to the combustion chamber, a shutoff element being arranged in this connecting conduit, the combustion chamber in particular being disposed at least partially annularly around the block.

9 Claims, 2 Drawing Figures

GLUE GUN

BACKGROUND AND SUMMARY OF THE INVENTION

The invention relates to a glue gun for conducting adhesive bonding by means of heated adhesive. The gun comprises a heating section and an angled handle with a hollow metal block which accommodates adhesive being arranged in the heating section.

Glue guns are known from practical usage comprising an elongated hollow block with a cylindrical recess, the hollow block consisting of a thermally conductive material, preferably a metal such as aluminum. An electrical heating element is in close contact with the hollow block and is used for heating the hollow block and, by way of the latter, an adhesive cartridge inserted in the block. The adhesive, softened by the heating step, can be readily extruded mechanically by means of a piston from the front end of the glue gun. One disadvantage in such glue guns resides in that they are heated by means of electric current, and an external source of current is required, on the one hand, due to the power required for heating and softening the adhesive and, on the other hand, in view of a long, continuous usefulness of such a gun, inasmuch as batteries could not generate the necessary energy.

Therefore, the invention is based on the object of creating a glue gun usable independently of an external source of current which yet is adequately powerful and also can be utilized in a continuous fashion for a sufficiently long period of the time.

According to the invention, the aforementioned object is attained by a glue gun comprising a hollow combustion chamber equipped with air inlet openings and provided integrally with a metal block of the gun which accommodated adhesive. A fuel tank is arranged in the handle; and that a connecting conduit is extended from the tank to the combustion chamber. A shutoff element is located in the connecting conduit. In a preferred embodiment of the glue gun, the combustion chamber is arranged at least partially annularly around the block.

Liquid gas is employed as the carrier for heating energy. The gas is contained in the fuel tank which can be either exchangeable or refillable. A high and adequate heating power is obtained by the use of liquid gas, which power can be used continuously for a long time without the necessity of interruption. Therefore, the glue gun of this invention can be utilized at various sites, especially where no electrical current supply is available. By the preferred construction of a combustion chamber arranged coaxially to the block, which latter contains the adhesive, or an annular combustion chamber, a heat generation is ensured that is equally distributed along the periphery. In order to heat the adhesive likewise in an optimally uniform fashion over a relatively long stretch, another preferred embodiment provides that the connecting conduit is extended in a spiral shape within the combustion chamber and the section of this conduit arranged within the combustion chamber is provided with outlets distributed over the length of this section. Thereby, the combustion process is allowed to proceed practically over the entire length of the combustion chamber, making it possible to effect a uniform operation by means of the glue gun of this invention.

In order to improve the combustion process, the provision is made that a combustion catalyst is fashioned as a double-cylinder shell, or that the conduit section in the combustion chamber is produced, as a combustion catalyst, of a wire mesh.

Additional advantages and features of the invention can be seen from the following description explaining embodiments of the glue gun of this invention in detail.

DETAILED DESCRIPTION

Figure 1:
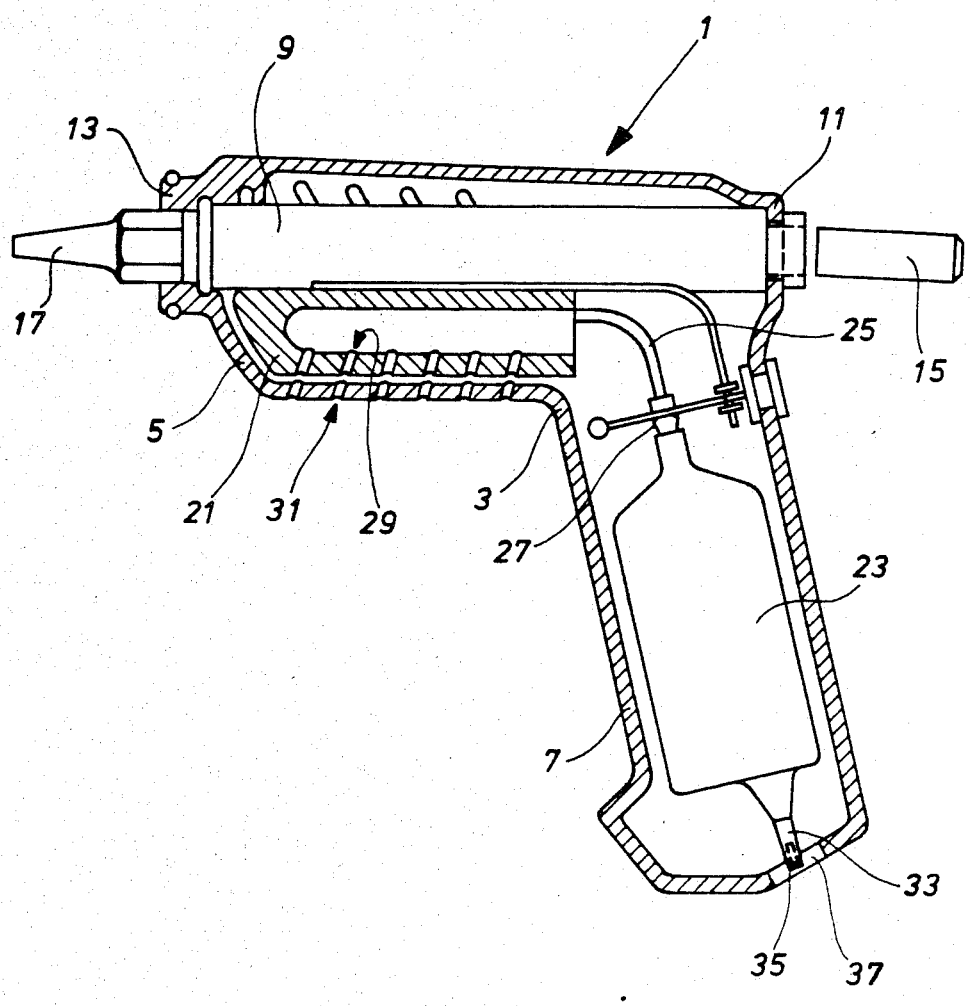
FIG. 1 shows a longitudinal section through a glue gun according to the invention.

Referring now to the drawings, particularly FIG. 1 thereof, it is seen that a glue gun 1 of this invention comprises a housing 3 exhibiting, in turn, a heating section 5 and a handle 7 angled with respect to the heating section.

A block 9 of a material having good heat conductivity, preferably a metal such as aluminum, is arranged essentially axially in the heating section 5. This block 9 has an essentially cylindrical cavity extending from a rear end 11 of the heating section 5 to a front end 13. A rod of adhesive 15 is introduced into this cavity and is heated in the block 9 to such an extent that heated adhesive of low viscosity can be forced out of a disharge member 17.

A combustion chamber 21 as the heating unit is constructed integrally with the block 9. The combustion chamber 21 is arranged below the block 9 in the embodiment shown in FIG. 1. The combustion chamber 21 likewise extends extensively in the same direction as the block 9. A fuel tank 23 for the accommodation of liquid fuel, gasifiable by means of a nozzle (not illustrated in detail), such as, in particular, liquid butane and propane, is disposed in the handle 7 of the housing 3. A connecting conduit 25 leads from the upper end of the fuel tank to the combustion chamber 21. A shutoff element 27, for example a valve, is located in the connecting conduit 25 adjacent the fuel tank 23, making it possible to control the fuel feed the liquid gas housed in tank 23 serves as the fuel as noted above. In order to initiate the combustion process in the combustion chamber 21, an igniting means known per se and not shown in detail, operable from the outside of the gun handle 7, is provided—preferably coupled with the valve 27. The combustion chamber 21 can furthermore exhibit a conventional cylindrical combustion catalyst. In order to supply the oxygen required for combustion, air inlets 29, as well as air inlets 31 associated therewith are arranged in the combustion chamber 21 and in the housing 3, respectively.

For putting the glue gun of the invention to use, a piece of adhesive 15 is introduced into the block 9. Subsequently the shutoff element 27 is opened and thereby fuel is introduced into the combustion chamber 21 while simultaneously actuating the ignition mechanism. The fuel housed in chamber 21 is ignited and heats the combustion chamber wall as well as the block 9 fashioned integrally therewith and, via the block, the adhesive 15 disposed in the block. The adhesive is thereby extensively liquefied and/or becomes viscous and can be urged by means of a piston—not shown—out of the discharge opening 17 and utilized for exact gluing. The fuel tank 23 can be designed to be either exchangeable or refillable. For refilling purposes, the tank is equipped at its rear end with an inlet 33 comprising a valve 35 accessible from a perforation 37 of the housing. The refilling valve is of conventional construction and is suitable for refilling the tank 23 from a refill vessel with fuel, preferably liquid gas.

Figure 2:
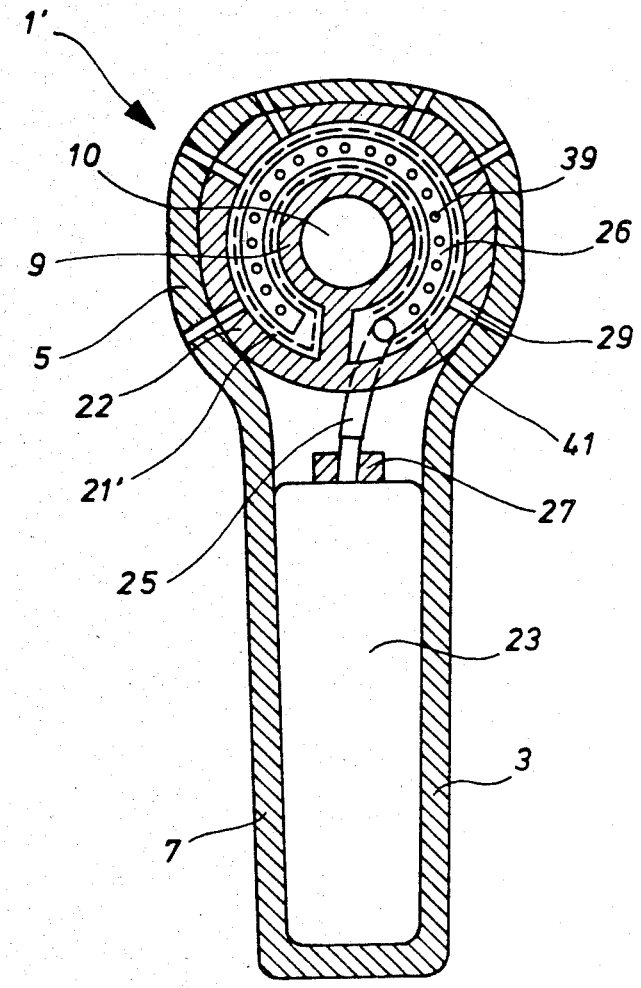
FIG. 2 is a cross section through another embodiment of a glue gun according to the invention.

FIG. 2 shows another embodiment of the glue gun 1' according to the invention, likewise comprising a housing 3 with a handle 7 and a heating section 5. A heat-conductive block 9 is provided in the heating section 5 and exhibits a cylindrical recess 10 which, in turn, can accommodate an adhesive. A combustion chamber 21' is arranged essentially concentrically around the block 9 and is sealed toward the outside by an annular outer wall 22 having air passages 29 therein. A connecting conduit 25 leads from a fuel tank 23 via a shutoff element 27 into the interior of the combustion chamber 21', which latter has the shape of a cylindrical shell. The section 26 of the connecting conduit 25 located in the interior of the combustion chamber 21' is inserted spirally in the combustion chamber 21' and is provided with gas outlets 39 over its length. Otherwise, the glue gun 1' of FIG. 2 is basically of the same construction as the glue gun 1 in FIG. 1; this applies, in particular, to the introduction and discharge of adhesive, the combination of the shutoff element 27 with an ignition mechanism (not shown), as well as the exchangeability and/or refillability of the fuel tank 23. Also the usage and function of the glue gun 1' of FIG. 2 correspond essentially to those of FIG. 1. The construction of FIG. 2, however, has the advantage that a more reliable and more uniform heating of the adhesive in block 9 is attained over its periphery as well as over its length. In order to improve the combustion characteristic, it is furthermore possible to arrange a combustion catalyst 41 in the combustion chamber 21'. The catalyst is made of a customary material, for example in the form of a metallic thread fabric, but lines the combustion chamber 21 according to this invention as a double-cylinder shell on both sides of the section 39 of conduit 25.

Also, the connecting conduit section (26) in the combustion chamber (21') may be produced as a combustion catalyst, of a wire mesh.

The features of the invention disclosed herein can be important for realizing the invention individually as well as in any desired combination, in its various embodiments.

We claim:

1. A glue gun for conducting adhesive bonding by means of a heated adhesive, comprising a housing having a heat section and an angled handle, a hollow metal block which accommodates the adhesive being arranged in the heating section of the housing, a hollow combustion chamber equipped with air inlet openings being provided within said housing, said combustion chamber being fashioned integrally with the metal block; a fuel tank arranged in the handle; and a connecting conduit extending from the tank to the combustion chamber, a shutoff element being located in this connecting conduit.

2. A glue gun according to claim 1, wherein the combustion chamber is arranged at least partially annularly around the block.

3. A glue gun according to claim 2, wherein a section of the connecting conduit is extended in spiral shape within the combustion chamber, the section of this conduit arranged in the combustion chamber being provided with outlets distributed along its length.

4. A glue gun according to claim 2, wherein a combustion catalyst is fashioned as a double-cylinder shell within said combustion chamber.

5. A glue gun according to claim 3, wherein the connecting conduit section in the combustion chamber is produced, as a combustion catalyst, of a wire mesh.

6. A glue gun according to claim 1, wherein the fuel tank is exchangeable.

7. A glue gun according to claim 1, wherein the fuel tank is refillable and is provided with a refilling valve.

8. A glue gun according to claim 1, wherein thermal insulation is provided to thermally insulate the block and the combustion chamber with respect to said housing, the thermal insulation being provided with air passages.

9. A glue gun for conducting adhesive bonding by means of a heated adhesive, comprising a heating section and an angled handle, a hollow metal block having a recess which accommodates the adhesive, said block being arranged in the heating section, an outer wall equipped with air inlet openings fashioned integrally with the metal block and extending about substantially the entire circumference of said recess, said outer wall enclosing a hollow combustion chamber, a fuel tank arranged in the handle, a connecting conduit extending from the tank to the combustion chamber, and a shutoff element located in said connecting conduit.

* * * * *